US008371259B2

(12) United States Patent
Steinle et al.

(10) Patent No.: US 8,371,259 B2
(45) Date of Patent: Feb. 12, 2013

(54) STARTER FOR STARTING AN INTERNAL COMBUSTION ENGINE HAVING A PINION SHAFT SUPPORT

(75) Inventors: Matthias Steinle, Muehlacker (DE); Gerhard Nonnenmann, Eberdingen (DE); Oliver Liebich, Kirchardt-Berwangen (DE); Uwe Ehrenwall, Stuttgart (DE); Gerhard Kraemer, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 582 days.

(21) Appl. No.: 12/312,261

(22) PCT Filed: Sep. 3, 2007

(86) PCT No.: PCT/EP2007/059191

§ 371 (c)(1),
(2), (4) Date: Feb. 8, 2010

(87) PCT Pub. No.: WO2008/052822

PCT Pub. Date: May 8, 2008

(65) Prior Publication Data

US 2010/0132648 A1 Jun. 3, 2010

(30) Foreign Application Priority Data

Nov. 2, 2006 (DE) ..... 10 2006 051 578

(51) Int. Cl.
*F02N 11/00* (2006.01)
*F02N 15/02* (2006.01)
*F02N 15/06* (2006.01)

(52) U.S. Cl. ..... 123/179.25; 74/7 C

(58) Field of Classification Search ..... 123/179.25, 123/185.6; 74/6, 7 C, 7 D, 7 E, 8, 9
See application file for complete search history.

(56) References Cited

U.S. PATENT DOCUMENTS

| | | | | |
|---|---|---|---|---|
| 4,916,958 | A * | 4/1990 | Okamoto et al. | 74/6 |
| 5,099,703 | A | 3/1992 | Isozumi | |
| 5,331,860 | A * | 7/1994 | Demoule et al. | 74/7 R |
| 5,806,366 | A * | 9/1998 | Vilou | 74/7 R |

FOREIGN PATENT DOCUMENTS

| | | |
|---|---|---|
| CN | 101573528 | 11/2009 |
| DE | 101 55 445 | 6/2002 |
| EP | 0 499 955 | 8/1992 |
| EP | 1 496 248 | 1/2005 |
| EP | 1 669 593 | 6/2006 |
| FR | 2 681 911 | 4/1993 |

* cited by examiner

*Primary Examiner* — Stephen K Cronin
*Assistant Examiner* — Sherman Manley
(74) *Attorney, Agent, or Firm* — Kenyon & Kenyon LLP

(57) ABSTRACT

A starter for starting an internal combustion engine has an electric starter motor, which has a drive shaft provided with an external toothing, a pinion shaft bearing a pinion, and a clutch element of a roller-type overrunning clutch situated between the drive shaft and the pinion shaft. The clutch element has an internal toothing mating with the external toothing of the drive shaft and is shiftable together with the pinion shaft away from the starter motor in the axial direction of the drive shaft into a meshing position in which the pinion mates with a gear wheel or ring gear of the internal combustion engine. The starter also has a device provided for directly supporting the pinion shaft on a section of the external toothing of the drive shaft facing away from the starter motor.

9 Claims, 3 Drawing Sheets

STARTER FOR STARTING AN INTERNAL COMBUSTION ENGINE HAVING A PINION SHAFT SUPPORT

BACKGROUND OF THE INVENTION

1. Field of the Invention

The present invention relates to a starter for starting an internal combustion engine, and relates in particular to a freely ejecting starter.

2. Description of Related Art

Frequently, so-called Bendix-type starters are used as electric starters for starting an internal combustion engine. These starters have an electric starter motor, the drive shaft of which drives a pinion shaft that is shiftable in a housing of the starter in the axial direction and that bears a pinion outside of the housing. The drive shaft has an external toothing in the form of a coarse thread, which mates with a complementary internal toothing of a clutch element, shiftable together with the pinion shaft, of a roller-type overrunning clutch between the drive shaft and the pinion shaft. Following the start of the internal combustion engine, the roller-type overrunning clutch prevents the starter motor from being driven by the internal combustion engine at an excessively high speed and thus damaged. To start the internal combustion engine, the starter is switched on, whereupon the pinion is meshed into a gear wheel or a ring gear of the internal combustion engine in that an meshing mechanism of the starter shifts the pinion shaft together with the clutch element of the overrunning clutch from an off position or rest position of the pinion into an meshing position, in which the pinion is meshed into the gear wheel or ring gear of the internal combustion engine and mates with it. When the pinion is driven by the starter motor in the meshing position via the drive shaft, the overrunning clutch and the pinion shaft in order to rotate the gear wheel or ring gear of the internal combustion engine, great reaction forces act on the pinion shaft in the region of the pinion.

While in so-called jaw starters the pinion shaft is supported on both sides of the pinion and may hardly be deflected by the radial forces acting on the pinion, in so-called freely ejecting starters the pinion shaft is supported only on one side of the pinion, namely within the housing of the starter. In a deflection of the pinion shaft as a result of the radial forces applied on the pinion, the pinion shaft in this case is suitably supported on the drive shaft via a bushing situated between the drive shaft and the hollow pinion shaft. Depending on the tolerance situation of the plays in the bearing and in the bushing, however, usually a part of the forces is also introduced via the rollers of the overrunning clutch into the clutch element and from there via the engaged toothings of the clutch element and of the drive shaft into the latter. As a result, there is a very high load applied locally on the opposite roller tracks developed on the pinion shaft and on the clutch element, which may result in an early wear of the roller tracks and thus in a reduction of the service life of the overrunning clutch and of the starter.

BRIEF SUMMARY OF THE INVENTION

The present invention is based on the objective of improving a starter of the type mentioned at the outset and in particular a freely ejecting starter in such a way that the roller tracks of the overrunning clutch have less load applied to them by the radial forces acting on the pinion shaft in the region of the pinion when starting the internal combustion engine.

According to the present invention, this objective is achieved by a device for supporting the pinion shaft in the meshing position on an end section of the external toothing of the drive shaft that faces away from the starter motor. This measure allows for the pinion shaft in the meshing position to be additionally supported in the region of its front end facing away from the pinion directly on the drive shaft if it is somewhat deflected as a result of the radial forces exerted on the pinion. In this manner, the forces required for supporting the pinion shaft may be introduced entirely into the drive shaft while bypassing the rollers of the overrunning clutch.

The present invention is based on the idea of maintaining an overlap, which already exists in the off position or rest position of the pinion shaft, between the pinion shaft and the external toothing of the drive shaft until the meshing position is reached so that in this position the pinion shaft may be supported in the overlap region on the external toothing of the drive shaft. In known freely ejecting starters, the overlap between the pinion shaft and the external toothing of the drive shaft indeed also exists in the off position or rest position, but it is not great enough so that it is lost already a while before reaching the meshing position.

According to an example embodiment of the present invention, the support device includes a bushing, whose front end, which faces the starter motor, overlaps with the external toothing or a front section of the external toothing facing the pinion. The measure of the overlap in the meshing position is preferably more than 1.5 mm so as to ensure a sufficient support of the pinion shaft on the external toothing, while on the other hand being suitably less than 3 mm so as to avoid increasing the overall length of the starter, which would not be desired by the customer.

Another development of the present invention provides for the bushing to be developed as a unit together with the pinion shaft and to form a hollow end section of the pinion shaft facing the starter motor. Alternatively, however, it is also possible to manufacture the bushing separately from the pinion shaft and to connect it to the pinion shaft in a rotatably fixed manner prior to installing the latter, for example by pressing the bushing into a corresponding bore of the pinion shaft. In both cases, the bushing juts suitably with radial play into an opposite bore of the clutch element of the overrunning clutch driven by the drive shaft.

The section of the external toothing of the drive shaft developed as a coarse thread, which in the meshing position overlaps with the bushing or the pinion shaft is not needed for transmitting the rotation of the drive shaft to the clutch element of the overrunning clutch and may therefore suitably have a greater crown-circle diameter than an adjacent section of the external toothing that mates with the internal thread of the clutch element such that in the overlapping region a very small radial play of approximately 0.1 to 0.15 mm may be set, which in the event of a deflection of the pinion shaft ensures that the latter is quickly supported on the external toothing of the drive shaft.

DETAILED DESCRIPTION

Figure 1:
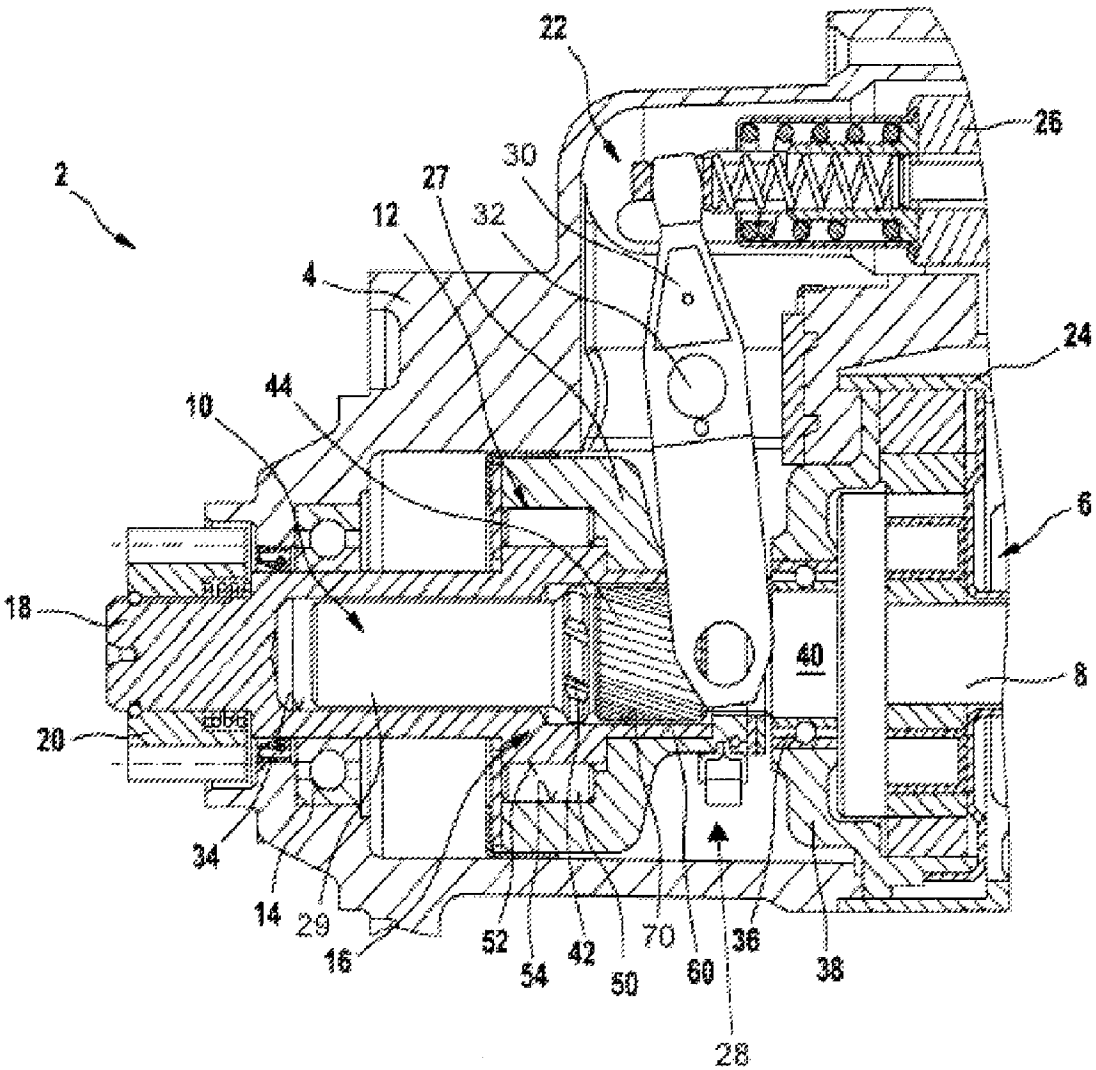
FIG. 1 shows a longitudinal section through a part of a starter according to the present invention in an off position or rest position of a pinion.

The freely ejecting Bendix-type starter 2 for an internal combustion engine shown only partially in the figures is made up of a starter housing 4, a starter motor 6 (only partially visible) accommodated in starter housing 4, the anchor 8 of which is connected in a rotatably fixed manner to an anchor shaft or drive shaft 10, a pinion shaft 16 supported in starter housing 4 via a roller bearing 14 and driven by drive shaft 10 via an overrunning clutch 12, which pinion shaft 16 bears a pinion 20 on its free end 18 outside of starter housing 4, and a meshing mechanism 22 for meshing pinion 20 into a ring gear or gear wheel (not shown) of the internal combustion engine. Meshing mechanism 22 includes an engaging relay 26 situated above a pole housing 24 of starter motor 6 and an engaging lever 30 situated between engaging relay 26 and a clutch element 28 of overrunning clutch 12. Engaging lever 30 may be swiveled clockwise around a hinged bearing 32 by supplying current to engaging relay 26 so as to shift clutch element 28 of overrunning clutch 12 together with pinion shaft 16 and pinion 20 from an off position or rest position of starter 2 shown in FIG. 1 in the axial direction toward the left in relation to drive shaft 10 into a meshing position shown in FIG. 2 in which pinion 20 is meshed into and mates with the ring gear or gear wheel of the internal combustion engine in order to start the internal combustion engine by supplying current to starter motor 6.

Drive shaft 10 juts with its front end 29 facing away from starter motor 6 into a stepped bore 70 of pinion shaft 16 which is open toward starter motor 6. Drive shaft 10 is provided with an external toothing between front end 29, which in the off position or rest position of pinion shaft 16 (FIG. 1) is inserted completely into a part 34 of stepped bore 70 having a reduced diameter, and a cylindrical section 40 supported in a pivot bearing 36 of a front bearing support 38 of pole housing 24. This external toothing is made up of two coarse thread sections 42, 44 differing in their number of teeth and situated one behind the other in the axial direction of drive shaft 10. In the example embodiment shown, the teeth of the two coarse thread sections 42, 44 have the same thread pitch, which does not necessarily have to be the case, however. The front coarse thread section 42 of drive shaft 10 facing away from starter motor has fewer teeth and a shorter axial extension than the rear coarse thread 44 next to starter motor 6.

Figure 2:
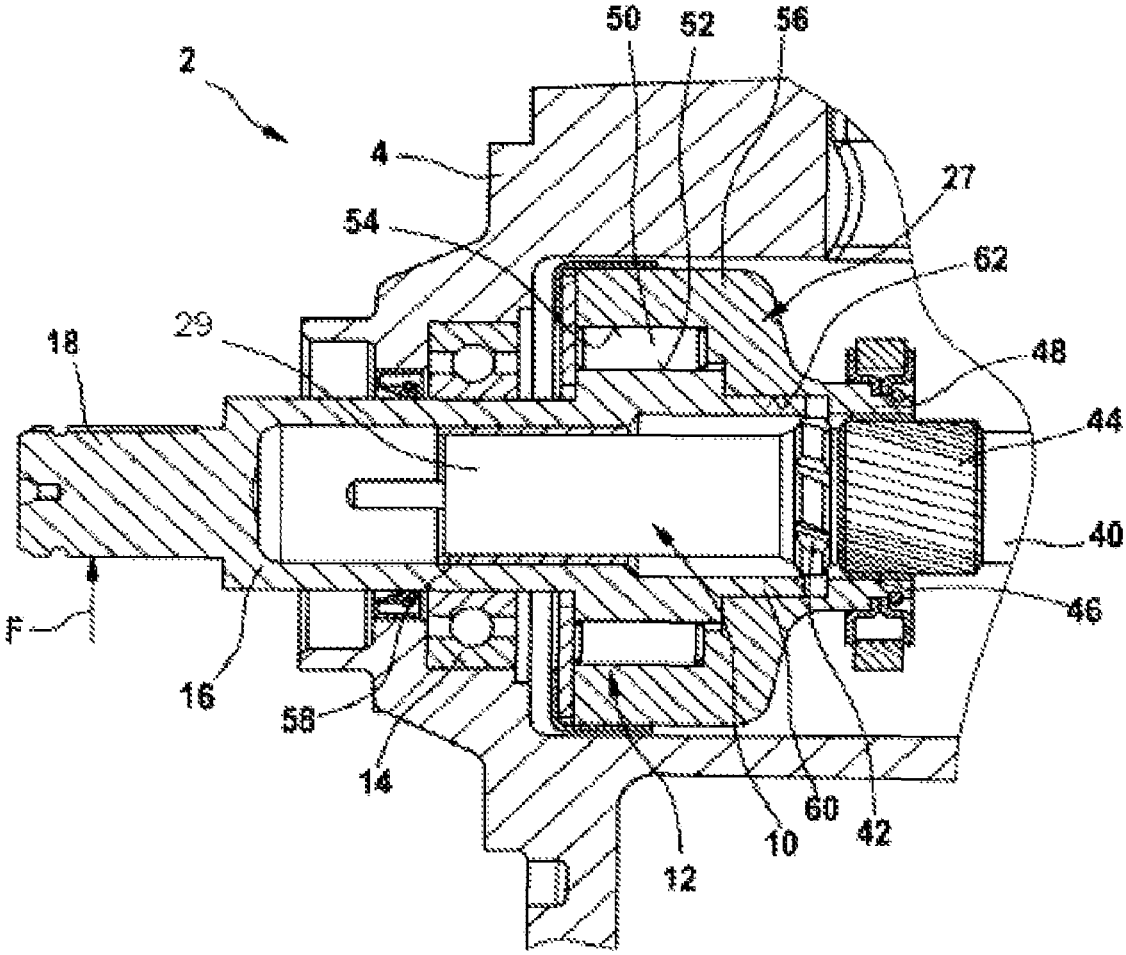
FIG. 2 shows a detail from FIG. 1, in a meshing position of the pinion.

As shown best in FIG. 2, rear coarse thread section 44 of the external toothing mates with a corresponding internal thread 46 in a driver section 48 of clutch element 28 of overrunning clutch 12 such that clutch element 28 is driven in a rotating manner by rotating drive shaft 10, but is at the same time shiftable in the axial direction between the off position or rest position (FIG. 1) and the meshing position (FIG. 2).

Overrunning clutch 12 has a plurality of clutch rollers 50, which are situated between an inner roller track 52 on the outer circumferential surface of a cross-sectionally widened section of pinion shaft 16 facing starter motor 8 and an outer roller track 54 on the inner circumference of a section 56 of clutch element 28 widened from driver section 48 in a pot-shaped manner, and which provide a transmission of the rotation of clutch element 28 to pinion shaft 16 when starting the internal combustion engine, but which allow for rotation of drive shaft 10 independent of the rotation of pinion shaft 16 as soon as the rotational speed of pinion shaft 16 driven by the internal combustion engine after the latter has started exceeds the rotational speed of drive shaft 10 of starter motor 6.

To ensure a radial support of pinion shaft 16, which is supported only on one side of pinion 20 in starter housing 4, when pinion shaft 16 is deflected within starter housing 4 in the meshing position of pinion 20 (FIG. 2) by a great radial force F (FIG. 2) applied on pinion 20 by the gear wheel or ring gear of the internal combustion engine outside of starter housing 4 when the internal combustion engine is started, a bushing 58 (FIG. 2) is situated in part 34 of stepped bore 70 between the inner circumferential surface of hollow pinion shaft 16 and the opposite outer circumferential surface of the front end 29 of drive shaft 10, via which pinion shaft 16 is supported on front end 29 of drive shaft 10 when pinion 20 is unilaterally loaded. While overrunning clutch 12 is free-wheeling, bushing 58 allows for a rotation between pinion shaft 16 and drive shaft 10.

As a function of the tolerance situation of the plays in bearing 14 of pinion shaft 16 and between bushing 58 and adjacent inner and outer circumferential surfaces of hollow pinion shaft 16 and front end 29 of drive shaft 10, a part of the counterforce required for supporting pinion shaft 16 is transmitted via rollers 50 of overrunning clutch 12 onto clutch element 28 and from there via internal thread 46 of driver section 48 and thread section 44 of the external thread of drive shaft 10 onto the latter, which could result in a high local load and thus in a wear of roller tracks 52, 54, and in order to prevent this effect, pinion shaft 16 shown in FIG. 2 has an integral extension bushing 60, which projects in the direction of starter motor 6 beyond the section of pinion shaft 16 provided with roller track 52 to such an extent that its free front end overlaps in the meshing position by a few millimeters with front coarse thread section 42 and is able to be supported by the latter when pinion 20 is loaded by force F. To ensure an early support in the overlapping region, only a very small radial play of approximately 0.1 to 0.15 mm is provided between a crown-circle diameter of the front coarse thread section 42 and a cylindrical inner circumference of extension bushing 60. In contrast, the play between the inner circumference of extension bushing 60 and the crown-circle diameter of rear coarse thread section 44 is approximately 0.5 to 0.7 mm when the latter is in the off position or rest position (FIG. 1) of pinion shaft 16 and during the axial shift of pinion shaft 16 into the meshing position (FIG. 2) within extension bushing 60.

Extension bushing 60 juts with play into a stepped bore 62 of clutch element 28 such that the latter is able to rotate when free-wheeling in relation to pinion shaft 16.

Figure 3:
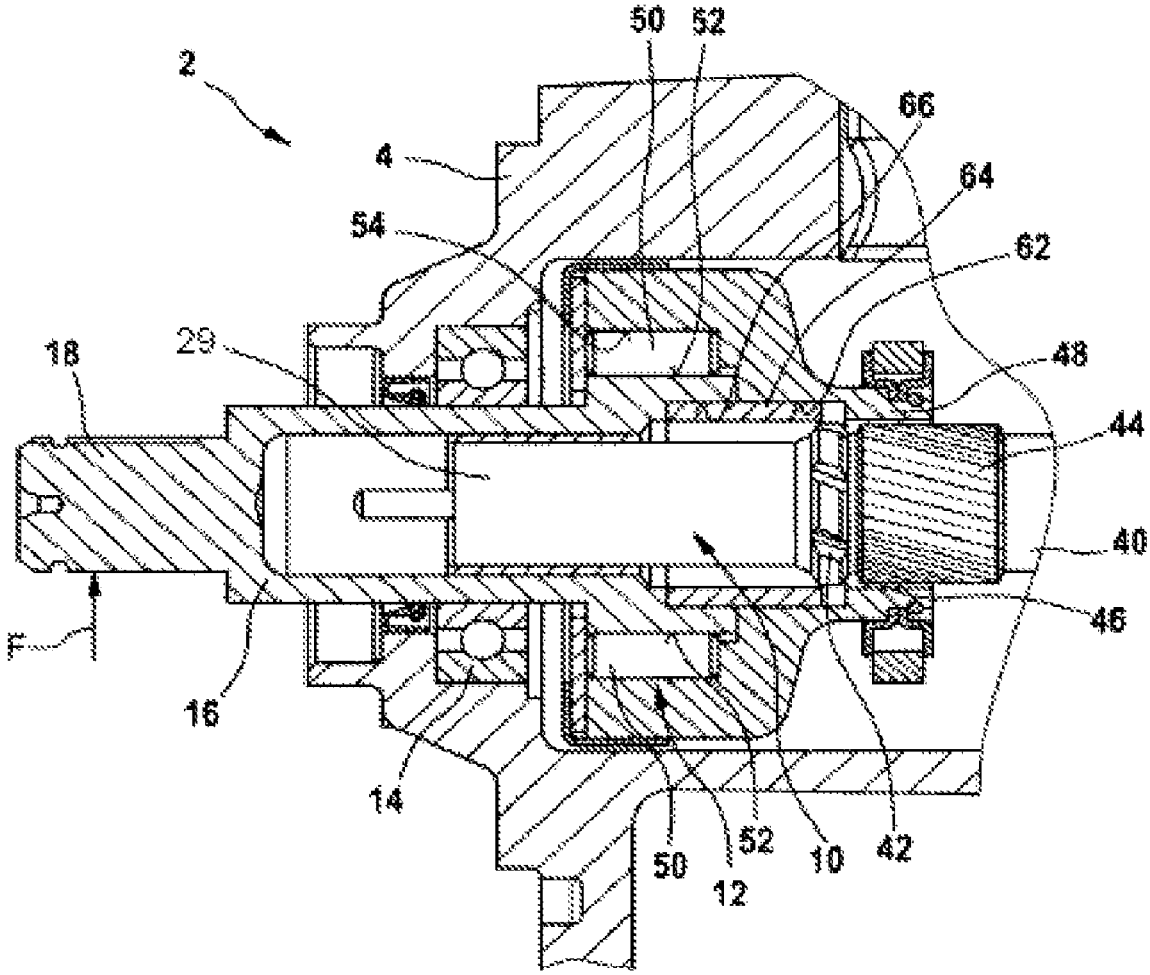
FIG. 3 shows a longitudinal section through another example embodiment of a starter according to the present invention in the meshing position of the pinion.

In the example embodiment shown in FIG. 3, pinion shaft 16 is supported on threaded section 42 of drive shaft 10 with the aid of a hollow-cylindrical bushing 64, which, unlike extension bushing 60, is not connected in one piece to pinion shaft 16, but is rather manufactured as a separate component and is pressed with its front part into a bore 66 in the rear front end of pinion shaft 16, while its rear part facing starter motor 6 juts with play into stepped bore 62 of clutch element 28 as in the specific embodiment from FIG. 2.

What is claimed is:

1. A starter for starting an internal combustion engine, comprising:

an electric starter motor having a drive shaft provided with an external toothing;

a pinion shaft bearing a pinion;

a clutch element of an overrunning clutch situated between the drive shaft and the pinion shaft, wherein the clutch element has an internal toothing that mates with a first section of an external toothing of the drive shaft to allow the clutch element to be shifted together with the pinion shaft away from the starter motor in the axial direction of the drive shaft into a meshing position in which the pinion mates with a gear wheel of the internal combustion engine; and a support device for supporting the pinion shaft in the meshing position on a second section of the external toothing of the drive shaft adjacent to the first section; wherein the support device includes a bushing including a front end facing the starter motor, and wherein the second section is axially further from the starter motor than the first section, overlaps with the bushing in the meshing position, and has a greater crown-circle diameter than the first section.

2. The starter as recited in claim 1, wherein the overlap by the front end is greater than 1.5 mm.

3. The starter as recited in claim 2, wherein the overlap by the front end is less than 5 mm.

4. The starter as recited in claim 3, wherein the bushing is made up of an integral part of the pinion shaft.

5. The starter as recited in claim 4, wherein the bushing forms a hollow end section of the pinion shaft facing the starter motor.

6. The starter as recited in claim 3, wherein the bushing is a component separate from the pinion shaft and connected to the pinion shaft in a rotatably fixed manner.

7. The starter as recited in claim 3, wherein a radial tolerance between the second section of the external toothing and an inner circumference of the bushing is less than 0.2 mm, and a radial tolerance between the first section of the external toothing and the inner circumference of the bushing is more than 0.4 mm.

8. The starter as recited in claim 3, wherein the second section of the external toothing and the first section of the external toothing have different numbers of teeth.

9. The starter as recited in claim 8, wherein the second section of the external toothing and the first section of the external toothing have different geometries.

* * * * *

UNITED STATES PATENT AND TRADEMARK OFFICE

CERTIFICATE OF CORRECTION

PATENT NO. : 8,371,259 B2
APPLICATION NO. : 12/312261
DATED : February 12, 2013
INVENTOR(S) : Steinle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 860 days.

Signed and Sealed this
First Day of September, 2015

Michelle K. Lee

Michelle K. Lee
*Director of the United States Patent and Trademark Office*